US005316269A

United States Patent [19]

Morita

[11] Patent Number: 5,316,269

[45] Date of Patent: May 31, 1994

[54] LEAF SPRING CONSTRAINING APPARATUS

[75] Inventor: Motoo Morita, Nagoya, Japan

[73] Assignee: Morita and Company Co., Ltd., Aichi, Japan

[21] Appl. No.: 997,785

[22] Filed: Dec. 29, 1992

[30] Foreign Application Priority Data

Sep. 24, 1992 [JP] Japan ..... 4-280444

[51] Int. Cl.[5] ..... C21D 9/00

[52] U.S. Cl. ..... 266/117; 148/646

[58] Field of Search ..... 266/114, 116, 117, 119; 148/645, 646

[56] References Cited

U.S. PATENT DOCUMENTS 1,434,184 10/1922 Allen ..... 266/116
1,776,084 9/1930 Peterson ..... 266/116
2,022,532 11/1935 Beans ..... 266/116

*Primary Examiner*—Scott Kastler
*Attorney, Agent, or Firm*—Koda and Androlia

[57] ABSTRACT

Disclosed is a constraining apparatus, for constraining cambered leaf spring blanks when they are quenched in an quenching oil in the oil tank of a quenching systems so as to prevent any possible distortion in the directions of the thickness and width of the blanks. The constraining apparatus basically consists of a drive system having a pair of sprockets, a drive shaft for driving the sprockets, a fixed disc and a pair of endless chains extended across the sprockets and the fixed disc, with a plurality of constrainers attached across these chains. The constrainer consists of a pair of support frame members; a plurality of slide shafts extended between these frame members on which carriers are disposed; a plurality of bases disposed to the respective carriers, which can be moved horizontally and transversely; a plurality of constraining jigs disposed to the respective bases which can constrain the blank in the directions of the thickness and width thereof; a plurality of locking means for locking the respective constraining jigs in position by locking the carriers and the bases; and a plurality of shifting means which can shift the locking means between the locked state and the released state; wherein the blank is immersed in the oil while it is constrained by the plurality of constraining jigs arranged in position along the camber profile of the leaf spring blank in the directions of the thickness and width thereof.

3 Claims, 8 Drawing Sheets 43
45
45a
46b
46a
47
46
48
44a
44
50
55a
55
55b
52b
52
53
54
27
50a
52a
56
43b
51
43a
45c
45b
49
44c
44b
24
10

LEAF SPRING CONSTRAINING APPARATUS

BACKGROUND OF THE INVENTION

This invention relates to a leaf spring constraining apparatus, more particularly to an apparatus for constraining leaves of a leaf spring or laminated spring, which constrains a leaf, cambered in the previous step, in the directions of the thickness and width thereof to effectively prevent possible strain which occurs when the cambered leaf is hardened or quenched by immersing it in an oil.

Suspension systems consisting of a plurality of leaves 10 which are laminated and bound as shown in FIG. 11 are suitably employed in land transportation vehicles such as railway cars and trucks. Each of the leaves 10 can be prepared, for example, after formation of an eye at one end portion or each end portion of a rolled plate blank having a predetermined thickness or a taper at the other end portion thereof, by subjecting the thus processed blank, which is heated entirely, to a cambering treatment so as to be provided with a predetermined camber. The camber to be imparted to the blank varies depending on the application and load stress: a type in which the camber angle gradually diminishes or increases from the center toward each end and a type in which the middle portion has no camber. The thus cambered blank 10 is quenched by immersing it in a quenching oil contained in an oil tank.

There is a serious problem when the cambered blank or leaf 10 is quenched in that the leaf undergoes distortion during cooling thereof if it is quenched by immersing it in the oil in a free state with no constraint. If the leaf 10 is distorted particularly in the direction of the thickness thereof, the camber profile itself will be changed, and thus the leaf 10 cannot be used as a normal product. Under such circumstances, it is attempted to immerse the leaf 10 having a camber into the quenching oil while the leaf 10 is constrained in the direction of the thickness thereof so as to prevent such distortion concomitantly occurring with cooling.

As described above, the distortion which affects the camber profile of the leaf 10 can be controlled by constraining the leaf 10 in the direction of the thickness thereof when it is quenched. However, since the leaf 10 is not constrained in the direction of the width thereof, there remains a possibility that the leaf 10 undergoes distortion in said direction. It should be noted here that the distortion in the direction of the width of the leaf 10 does not affect the camber profile, so that the leaves 10 which underwent such widthwise distortion can be treated by operators to correct such distortion after quenching and used as normal products.

However, since the degree of widthwise distortion varies depending on the leaves 10, it requires the skill of an expert to correct such distortion into a specified tolerable range. Namely, intricate and time-consuming correcting procedures were required after the quenching treatment, leading to reduction in the productivity of leaves 10, disadvantageously.

OBJECT AND SUMMARY OF THE INVENTION

This invention is proposed in view of the problems inherent in the quenching of leaf spring blanks and for solving them successfully, and it is an object of the invention to provide a leaf spring constraining apparatus enabling quenching with high accuracy by preventing occurrence of distortions in the directions of the thickness and width of the leaf whereby to improve productivity of leaf springs.

In order to overcome the above problems and attain the intended object, a first aspect of the invention is to provide

- a constraining apparatus, for constraining a leaf spring blank to which a predetermined camber has been imparted, to be disposed in a liquid tank containing a predetermined amount of quenching liquid, said apparatus comprising:
- a plurality of support frames disposed to a drive system provided in said oil tank to be spaced from one another in the longitudinal direction of said leaf spring blank, which frames are movable between the position where said leaf spring blank is immersed in the quenching liquid and a position where said leaf spring blank is drawn up from said liquid;
- a plurality of carriers disposed to be slidable on a plurality of slide shafts, extended parallel to the longitudinal direction of said leaf spring blank between said support frames;
- a plurality of bases disposed to the respective carriers, which can move in the direction of imparting camber to said leaf spring blank which is orthogonal to the direction toward which the carriers are moved;
- a plurality of constraining jigs disposed to the respective bases which can constrain said leaf spring blank in the directions of the thickness and width thereof;
- a plurality of locking means for locking the respective constraining jigs in position by locking said carriers and said bases; and
- a plurality of shifting means which can shift said locking means between the locked state and the released state;
- wherein said leaf spring blank is immersed in said liquid while it is constrained by said plurality of constraining jigs arranged in position along the camber profile of said leaf spring blank in the directions of the thickness and width thereof.

A second aspect of the invention is to provide a constraining apparatus, for constraining a leaf spring blank to which a predetermined camber has been imparted, to be disposed in a liquid tank containing a predetermined amount of quenching liquid, said apparatus comprising:

- a plurality of support frames disposed to a drive system provided in said oil tank to be spaced from one another in the longitudinal direction of said leaf spring blank, which frames are movable between the position where said leaf spring blank is immersed in the quenching liquid and a position where said leaf spring blank is drawn up from said liquid;
- a plurality of carriers disposed to be slidable on a plurality of slide shafts, extended parallel to the longitudinal direction of said leaf spring blank between said support frames;
- a plurality of bases disposed to the respective carriers, which can move in the direction of imparting camber to said leaf spring blank which is orthogonal to the direction toward which the carriers are moved;
- a plurality of constraining jigs disposed to the respective bases which can constrain said leaf spring blank in the directions of the thickness and width thereof;

a position adjuster for adjusting the positions of said constraining jigs in the longitudinal direction of said leaf spring blank as well as in said camber imparting direction;

a plurality of locking means for locking said constraining jigs in position by locking said carriers and said bases; and a plurality of shifting means which can shift said locking means between the locked state and the released state;

wherein said leaf spring blank is immersed in said liquid while it is constrained by said plurality of constraining jigs arranged in position along the camber profile of said leaf spring blank in the directions of the thickness and width thereof.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

The leaf spring constraining apparatus of the invention 15 will now be described by way of a preferred embodiment.

Overall Constitution of Quenching System

Figure 2:
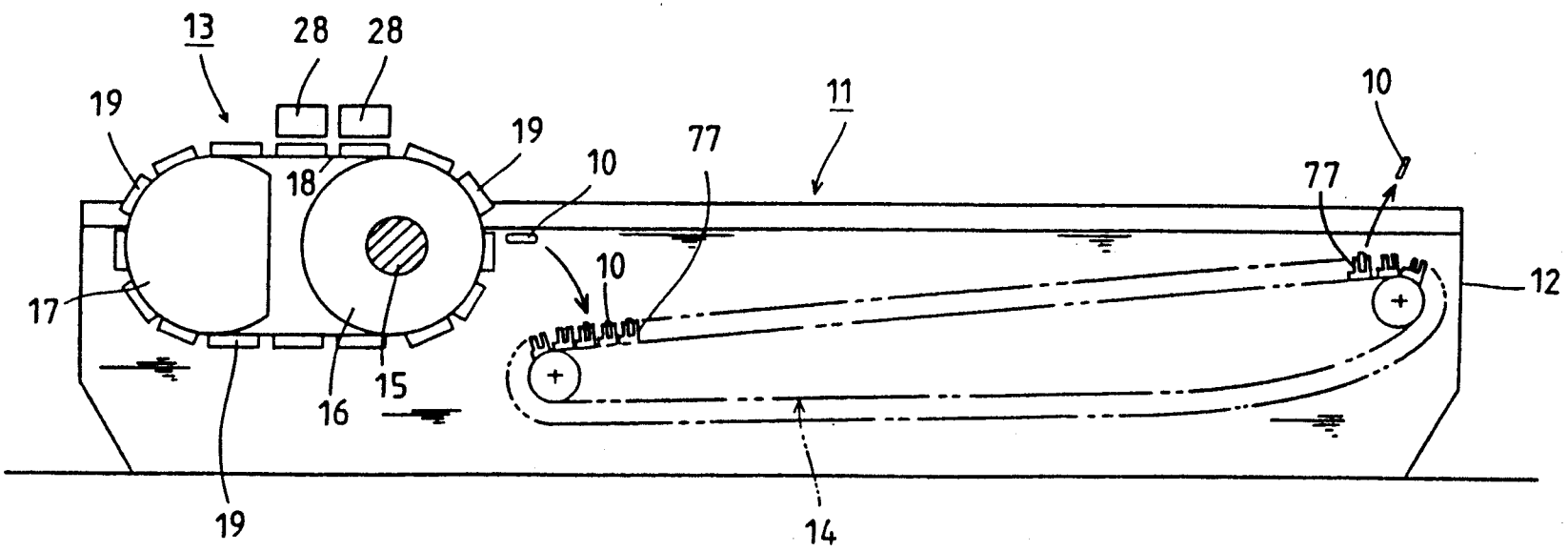
FIG. 2 is a schematic constitutional view of a quenching system employing the constraining apparatus according to the embodiment of the invention.

FIG. 2 is a schematic constitutional view of a quenching system in which the constraining apparatus according to the embodiment of the invention is employed. The quenching system 11 basically consists of an oil tank 12 containing a predetermined amount of quenching oil, a constraining apparatus 13, disposed in the oil tank 12, which constrains leaves 10 and a conveyor 14, also disposed in the oil tank 12, which carries the leaves 10 transferred from the constraining apparatus 13. Leaves 10 which are properly cambered in the previous step are designed to be immersed in the oil for a predetermined time while they are constrained in the constraining apparatus 13 in the directions of the width and thickness of the leaves 10 to effect quenching. The leaves 10 thus quenched under constraint and having a stabilized camber profile are transferred from the constraining apparatus 13 to the conveyor 14 and carried thereon in the oil for a predetermined time, whereby to effect further quenching.

Constraining Apparatus

A drive shaft 15 is disposed rotatably in the oil tank 12, at an upstream position in the line of feeding leaves 10, orthogonally to the leaf feeding direction. A pair of sprockets 16 (only one sprocket is shown) are fixed to the drive shaft 15 to be spaced axially from each other with a predetermined distance therebetween. These sprockets 16 are designed to be rotated synchronously with most of their bodies being immersed in the oil. A fixed disc 17 is disposed at a position upstream the drive shaft 15 to oppose the sprockets 16 with a predetermined space therebetween, and a pair of endless chains 18 are extended across the fixed disc 17 and the sprockets 16, respectively. A plurality (16 in the embodiment) of constrainers 19 are designed to be disposed between these endless chains 18 extended in parallel to each other along the running direction. The constrainers 19 are allowed to be fed intermittently in a predetermined direction by the predetermined angle (36° in the embodiment) by driving the drive shaft 15 with a drive means (e.g. servo motor). Incidentally, if leaves 10 are not to be quenched under no constraint in the quenching system 11, the length of the endless chains 18 (distance between the sprockets 16 and the fixed disc 17) can be elongated to carry out quenching of a larger number of leaves 10 in the oil tank 12 having the same dimensions.

Constrainer

Figure 1:
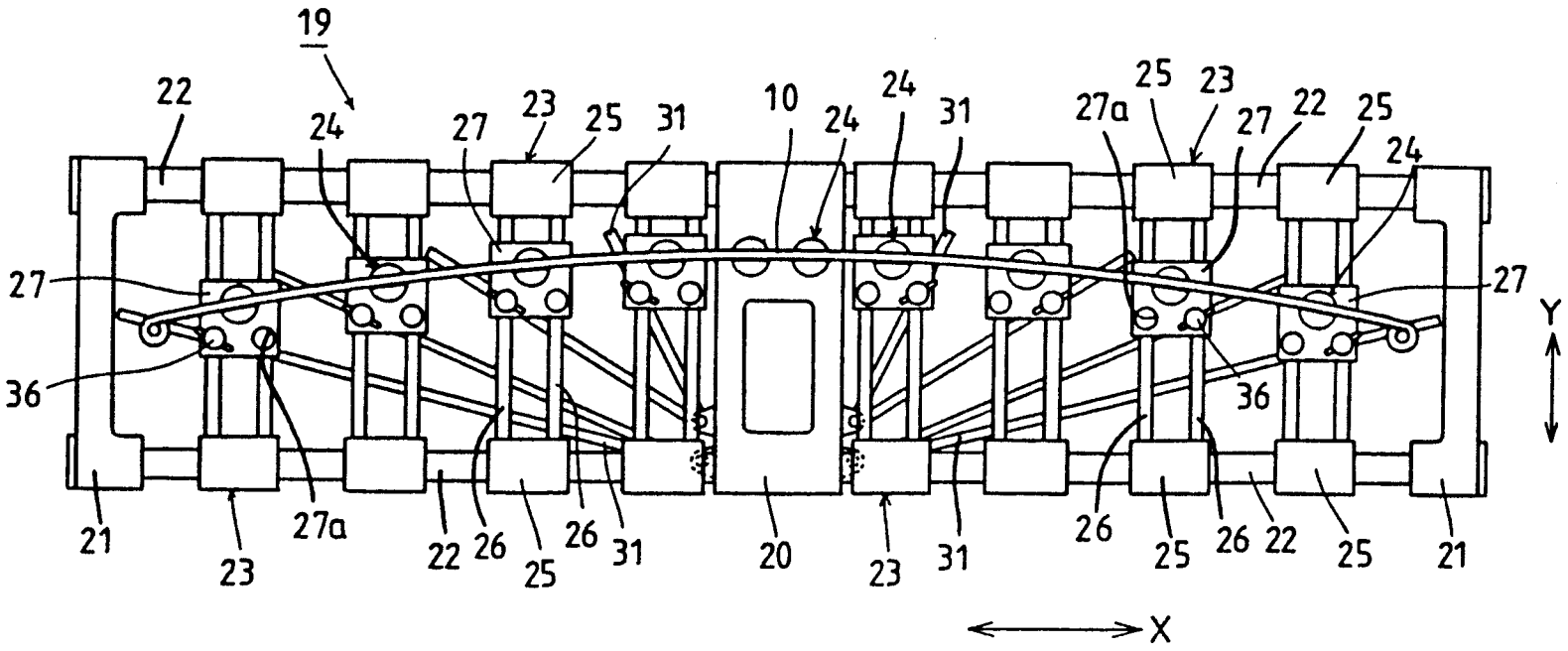
FIG. 1 is a front view of a constrainer of the constraining apparatus according to one embodiment of the invention.

As shown in FIG. 1, each of the constrainers 19 disposed between the endless chains 18 has a center frame 20 locating substantially at the center of the distance between the chains 18 and a pair of support frames 21 disposed on each side of the center frame 20 spaced with a predetermined distance along the drive shaft 15, with a plurality of slide shafts 22 being extended parallel to one another between the center frame 20 and the support frames 21 respectively. Four each of carriers 23 are provided on each side of the center frame 20, and a constraining jig 24 (to be described later) for constraining the leaf 10 is disposed to each carrier 23. A couple of constraining jigs 24 are also disposed to the center frame 20, and the leaf 10 is adapted to be constrained in the directions of the thickness and width thereof at ten positions along the length thereof.

Figure 4:
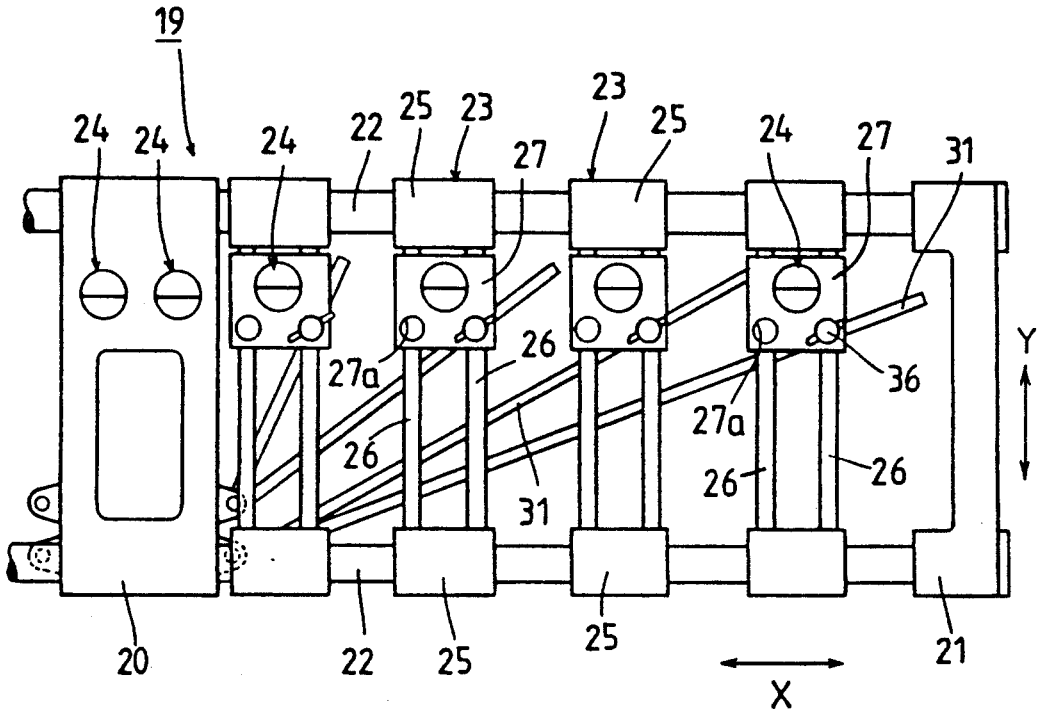
FIG. 4 shows partially in front view the constrainer.

As shown in FIG. 4, each of the carrier 23 has a pair of guide pieces 25 slidably fitted to the corresponding slide shafts 22 respectively and a pair of guide shafts 26 extended parallel to each other across the guide pieces 25 to be orthogonal to the slide shafts 22. A base 27 is mounted slidably onto each pair of guide shafts 26, to which the constraining jig 24 is fixed. The base 27 also has an opening 27*a* in which the positioning pin 29 of a position adjuster 28 (to be described later) is to be inserted, so that the position of the base 27 can be adjusted by the position adjuster 28 in the longitudinal direction (X) of the leaf 10 as well as in the camber imparting direction (Y). Thus, the positions of the plurality of constraining jigs 24 locating on each side of the center frame 20 can be adjusted depending on the length and camber profile of the leaf 10.

Position Locking Mechanism in Base

Figure 5:
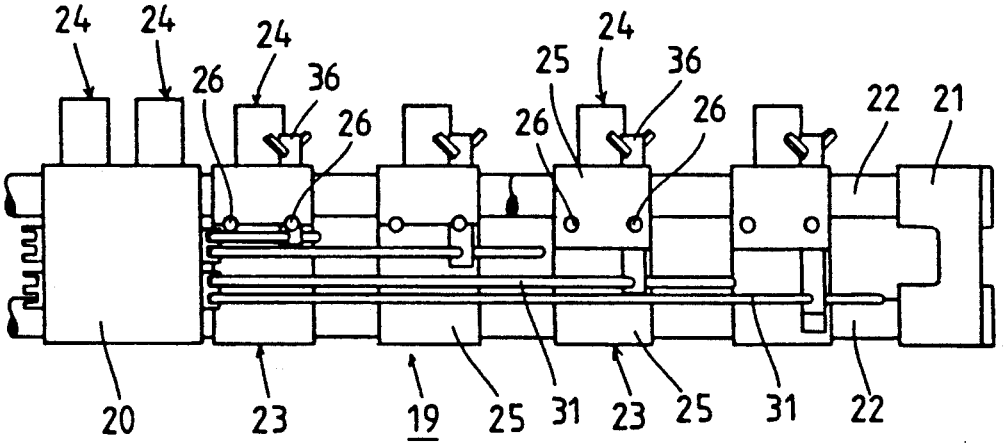
FIG. 5 shows partially in bottom view the constrainer.

As shown in FIG. 7, a retainer 30 having an upper chamber 30*a* and a vertical through hole 30*b* communicating to the bottom of the upper housing 30*a* is disposed to the base 27, and the upper housing 30*a* is designed to appear on the front face (the side where the leaf 10 is constrained) of the base 27. A through hole 30*c* is defined diametrically in the retainer 30 at the portion protruding with a predetermined length to the rear surface of the base 27, in which a corresponding positioning bar 31 supported at one end to the center frame 20 is inserted, so that the retainer 30 can slide on a corresponding positioning bar 31 in the direction Y as well as in the direction X (see FIG. 5). Meanwhile, another through hole 30*d* is defined at a position higher than the level of the through hole 30*c* of the retainer 30, in which one guide shaft 26 is designed to be inserted. The guide shaft 26 inserted to the through hole 30*d* is adapted to be able to move slightly vertically therein. Incidentally, a pusher 32 is disposed in the vertical through hole 30*b* between the positioning bar 31 and the guide shaft 26, so that the base 27 can be locked at a predetermined position by bringing the pusher 32 into press contact with the positioning bar 31 and the guide shaft 26.

A locking member 33 is slidably inserted through the upper housing 30*a* to the vertical through hole 30*b* of the retainer 30 up to the level above the guide shaft 26, and the locking member 33 has a collar 34 at an upper portion thereof accommodated in the upper housing 30*a*. A coned disc spring 35 is interposed between the collar 34 and the inner bottom of the upper housing 30*a*, so that the locking member 33 can constantly be urged upward thereby. It should be noted that the upper end of the locking member 33 is designed to protrude to a predetermined height through the upper opening 30*e* defined in the retainer 30.

A cam 36 is pivotally supported by a pin 38 onto a bracket 37 provided on the retainer 30, which is abutted against the upper end of the locking member 33. The cam 36 has a first cam surface 36*a* and a second cam surface 36*b*. As shown in FIG. 7, the cam 36 also has a release lever 39 and a clamp lever 40 secured thereto, so that the cam 36 can be turned counterclockwise by urging the release lever 39 downward with a releasing air cylinder 41 (to be described later) to allow the first cam surface 36*a* to be abutted against the locking member 33, whereas the cam 36 can be turned clockwise by urging the clamp lever 40 downward with a clamping air cylinder 42 (to be described later) to allow the second cam surface 36*b* to be abutted against the locking member 33. In the state where the first cam surface 36*a* is abutted against the locking member 33, as shown in FIG. 7(*a*), the locking member 33 is adapted to be lifted by the resilience of the coned disc spring 35 to allow the lower end thereof to be spaced from the guide shaft 26, whereby to allow movement of the retainer 30 relative to the guide shaft 26 and the positioning bar 31. Meanwhile, in the state where the second cam surface 36*b* is abutted against the locking member 33, as shown in FIG. 7(*b*), the locking member 33 is adapted to be pushed downward against the resilience of the coned disc spring 35 to allow the lower end thereof to be abutted against the guide shaft 26, whereby to bring the pusher 32 to be in press contact with the positioning bar 31 via the guide shaft 26. Consequently, the retainer 30 can be locked relative to the guide shaft 26 and the positioning bar 31, and thus the base 27 can be locked in position.

Constraining Jig

Figures 8A, 8B:
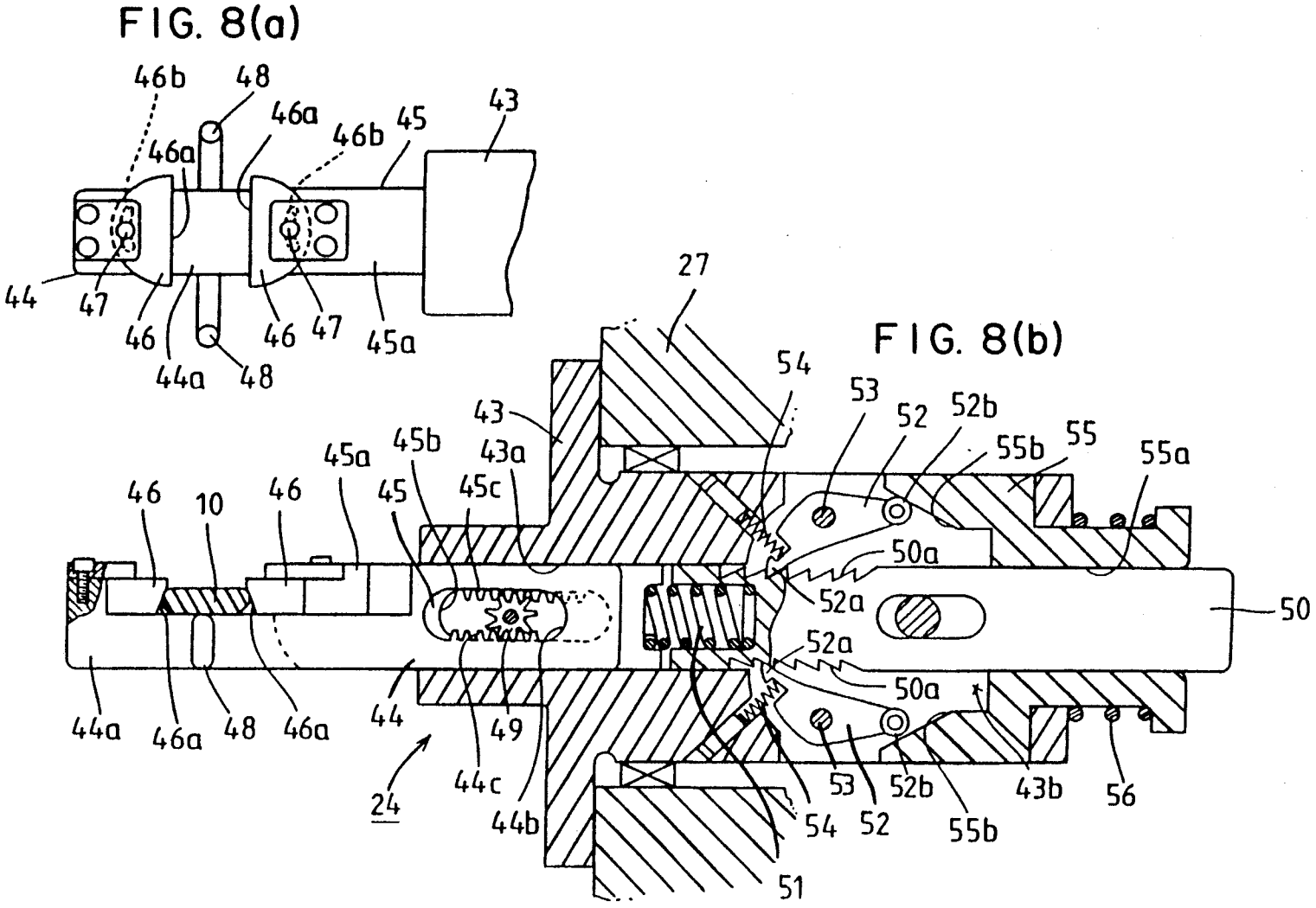
FIGS. 8(*a*) and 8(*b*) show a schematic constitutional view of a constraining jig.

The constraining jig 24 to be disposed to each base 27 is directed to constrain a leaf 10 having a predetermined camber in the directions of the thickness and width thereof. Namely, as shown in FIG. 8, a jig body 43 having a through hole 43*a* is pivotally supported onto the base 27, and a pair of holders 44,45 are slidably inserted to the through hole 43*a*. One holder 44 has an L-shaped arm 44*a* protruding with a longer length outward from the through hole 43, and a semicircular jaw 46 is disposed onto the upper surface at the free end portion of the arm 44*a*. The jaw 46 has an arcuate slot 46*b*, as shown in FIG. 8(*b*), and is slidably supported by a pin 47 inserted to the slot 46*b*, so that the jaw 46 can slide in the circumferential direction thereof relative to the arm 44*a*. The other holder 45 has an arm 45*a* protruding with a shorter length outward from the through hole 43*a* and extending in contact with the upper surface of the arm 44*a*, and a semicircular jaw 46 is also supported slidably onto the free end portion of the arm 45*a* by a pin 47, inserted to a slot 46*b* defined therein, in such a way that the constraining surface 46*a* thereof may oppose to that of the other jaw 46. I should be noted that the slot 46*b* in the jaw 46 disposed to the arm 45*a* is defined in the same arcuate shape and in the same orientation.

The opposing constraining surfaces 46*a* of the jaws 46 are slanted to be spaced farther from each other toward the upper surface of the arm 44*a*, as shown in FIG. 8(*a*), and hold the leaf 10 mounted on the arm 44*a* widthwise therebetween, whereby the bottom surface of the leaf 10 is pressed against the arm 44*a*. Thus, the leaf 10 is constrained in the directions of the width and thickness thereof to be prevented from distorting in said directions. Since the jaws 46 are disposed to the holders 44,45 to be slidable along the slots 46*b*, respectively, the edge of the jaws 46 can be abutted parallel to the side edges of the leaf 10, whereby to prevent the leaf 10 from being scratched by the jaws 46. Incidentally, a pair of auxiliary levers 48 extend outward from each side of the arm 44*a* of the holder 44 in the longitudinal direction of the leaf 10, as shown in FIG. 8(*b*). These auxiliary levers 48 are operated by the leaf 10 brought into contact therewith when the leaf 10 is mounted on the upper surface of the arm 44*a*, to turn the jig body 43 relative to the base 27, so that the arm 44*a* can assume a proper angle conforming to the camber profile of the leaf 10 and allow the leaf 10 to be placed on the upper surface of the arm 44*a* substantially parallel thereto.

Mechanism for Operating Jaws

As shown in FIGS. 8(*a*) and 9, slots 44*b*,45*b* are defined in the holders 44,45 at the portions accommodated in the through hole 43*a*, respectively, and a pinion 49 rotatably supported onto the jig body 43 is fitted in common into these slots 44*b*,45*b*. The slot 44*b* of the holder 44 has a rack 44*c* formed on the lower edge thereof, which engages with the pinion 49, whereas the slot 45*b* of the holder 45 has a rack 45*c* formed on the upper edge thereof, which also engages with the pinion 49. Namely, the pair of holders 44,45 can be moved in such a way that the jaws 46 disposed respectively thereto may be moved to be closer to or farther from each other by rotating the pinion 49 positively or negatively.

A thrust shaft 50 is slidably disposed at a position behind the holders 44,45 in the through hole 43*a* of the jig body 43, and a compression spring 51 is resiliently interposed between the thrust shaft 50 and one holder 45. A cavity 43*b* communicating to the through hole 43*a* is also defined in the jig body 43, which opens to each side of the jig body 43. At the portion of the thrust shaft 50 accommodated in this cavity 43*b*, toothed portions 50*a* are formed on each side thereof. A pair of latches 52, which can be engaged with the corresponding toothed portions 50*a* are pivotally supported by pins 53 in the cavity 43*b*. The latches 52 are designed to be urged by the resilience of compression springs 54 interposed between them and the jig body 43 in the direction where the claws 52*a* thereof may constantly be engaged with the toothed portions 50*a*, respectively. In the state where the claws 52*a* of the latches 52 are engaged with the toothed portions 50*a*, the thrust shaft 50 is designed to be able to advance but not to retract. Incidentally, the compression spring 51 is connected at one end to the holder 45 and at the other end to the thrust shaft 50, so that the holder 45 can follow the thrust shaft 50 when the thrust shaft 50 is retracted.

In other words, when the leaf 10 is to be constrained between the jaws 46 by operating the operation mechanism, the thrust shaft 50 is advanced after a leaf 10 is placed between the jaws 46 to allow one holder 45 to advance via the compression spring 51, whereas to allow the other holder 44 to be retracted by the pinion 49. Thus, the jaws 46 of the holders 44,45 approach to each other and are abutted against the leaf 10. The thrust shaft 50 can be positioned by the engagement of the latches 52 with the corresponding toothed portions 50*a*, so that the leaf 10 can firmly be held between the jaws 46 with the aid of the resilience of the compression spring 51. Incidentally, the tooth pitch of these toothed portion 50*a* is staggered by ½, so that the position of the thrust shaft 50, or the distance between the jaws 46 when the latches 52 are engaged with the toothed portions 50*a*, can finely be adjusted depending on the widths of leaves 10.

Figure 10:
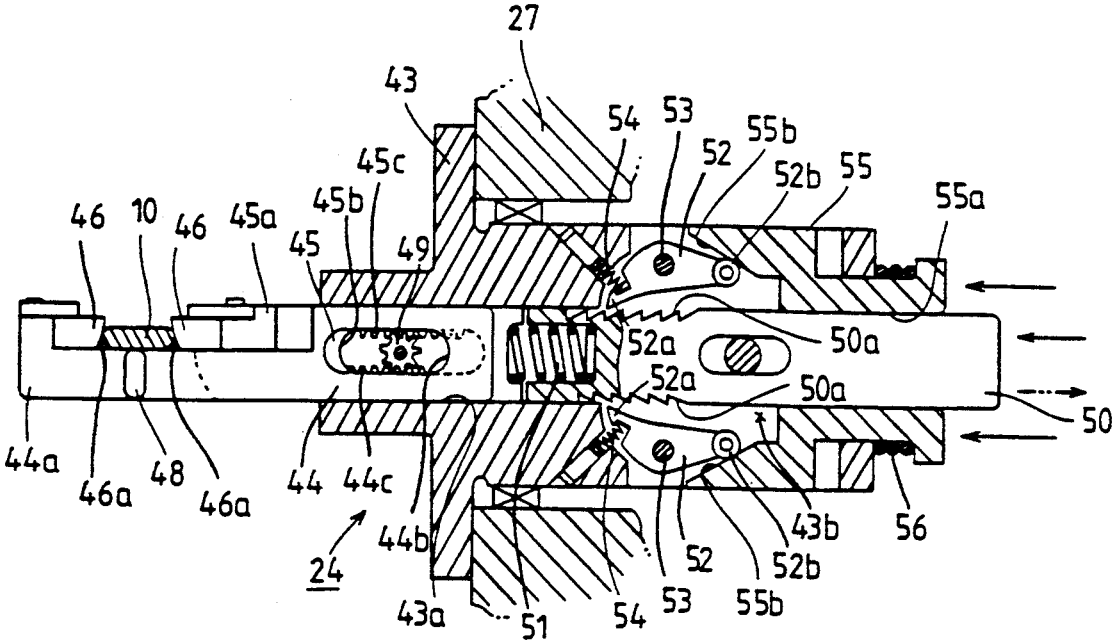
FIG. 10 illustrates how constraint applied to the leaf by the constraining jig is released.
Figure 11:
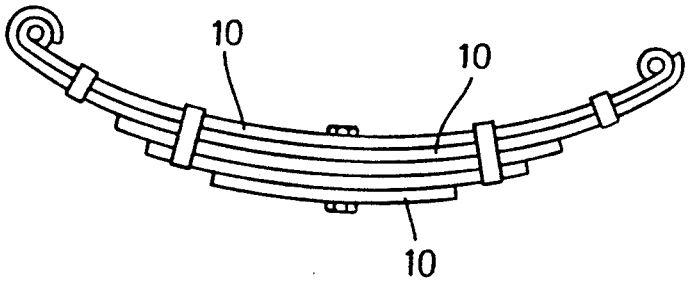
FIG. 11 illustrates a suspension system employing a leaf spring.

The jig body 43 has a releasing member 55 disposed slidably in the cavity 43*b* thereof at the position behind the latches 52, and the releasing member 55 is used for releasing constraint applied to the leaf 10 by the jaws 46. A through hole 55*a* is defined in the releasing member 55 coaxially with the through hole 43*a* of the jig body 43, in which the rear half of the thrust shaft 50 is inserted with the end portion thereof protruding backward from the releasing member 55. The rear end portion of the releasing member 55 also protrudes backward from the jig body 43 and is designed to be constantly urged backward (in the direction to be spaced from the latches 52) by a compression spring 56 interposed between the rear end portion of the jig body 43 and the flange of the releasing member 55. The releasing member 55 has a tapered surface 55*b*, which slopes radially outward, along the inner circumference at the front end portion thereof, and a roller 52*b* disposed to each latch 52 on the side opposite to the claw 52*a* thereof relative to the pin 53 is designed to be abutted against the tapered surface 55*b*. Namely, the rollers 52*b* of the respective latches 52 roll along the tapered surface 55*b* by advancing the releasing member 55 against the resilience of the compression spring 56, whereby to allow the latches 52 to pivot in the direction to be spaced from the corresponding toothed portions 52*a* and release their engagement with the thrust shaft 50, as shown in FIG. 10. Subsequently, by retracting the thrust shaft 50 to retract one holder 45 connected thereto via the compression spring 51, the other holder 44 is allowed to be advanced by the pinion 49, whereby the jaws 46 are spaced from each other to release the leaf 10.

As the drive means for advancing or retracting the thrust shaft 50 and the releasing member 55, an air cylinder, for example, can suitably be used, whereas the drive means for advancing the thrust shaft 50 so as to constrain the leaf 10 between the jaws 46 is disposed at a position corresponding to the place where leaves 10 are supplied to the constraining apparatus 13. The drive means for advancing or retracting the thrust shaft 50 and the drive means for advancing the releasing member 55 to release constraint applied by the jaws 46 to the leaf 10 are disposed at the position corresponding to the place where the leaf 10 is unloaded from the constraining apparatus 13. Incidentally, since the relative positions of the constraining jigs 24 to be disposed to the respective bases 27 of the constrainer 19 are designed to be adjusted depending on the dimensions and camber profile of the leaf 10, the positions of the respective drive means can be adjusted correspondingly to be able to actuate the mechanism for operating the corresponding constraining jig 24.

Position Adjuster for Constraining Jigs

When leaves 10 having a different length and/or a camber profile are to be quenched in accordance with the order change, the positions of the constraining jigs 24 disposed to the respective bases 27 in each constrainer 19 must be readjusted by moving the bases 27 in the direction X as well as in the direction Y so as to be able to constrain the leaves 10 at proper positions by the constraining jigs 24. Accordingly, a pair of position adjusters 28, one for adjusting the positions of the bases 27 (constraining jigs 24) locating on the right side of the center frame 20 and the other for those locating on the left side of the center frame 20 of the constrainer 19, are disposed to be spaced from each other in the direction of feeding constrainers 19. Since these position adjusters 28 are of the same constitution, only the one locating upstream, for adjusting the bases 27 on the right side of the center frame 20, will be described.

Figure 6:
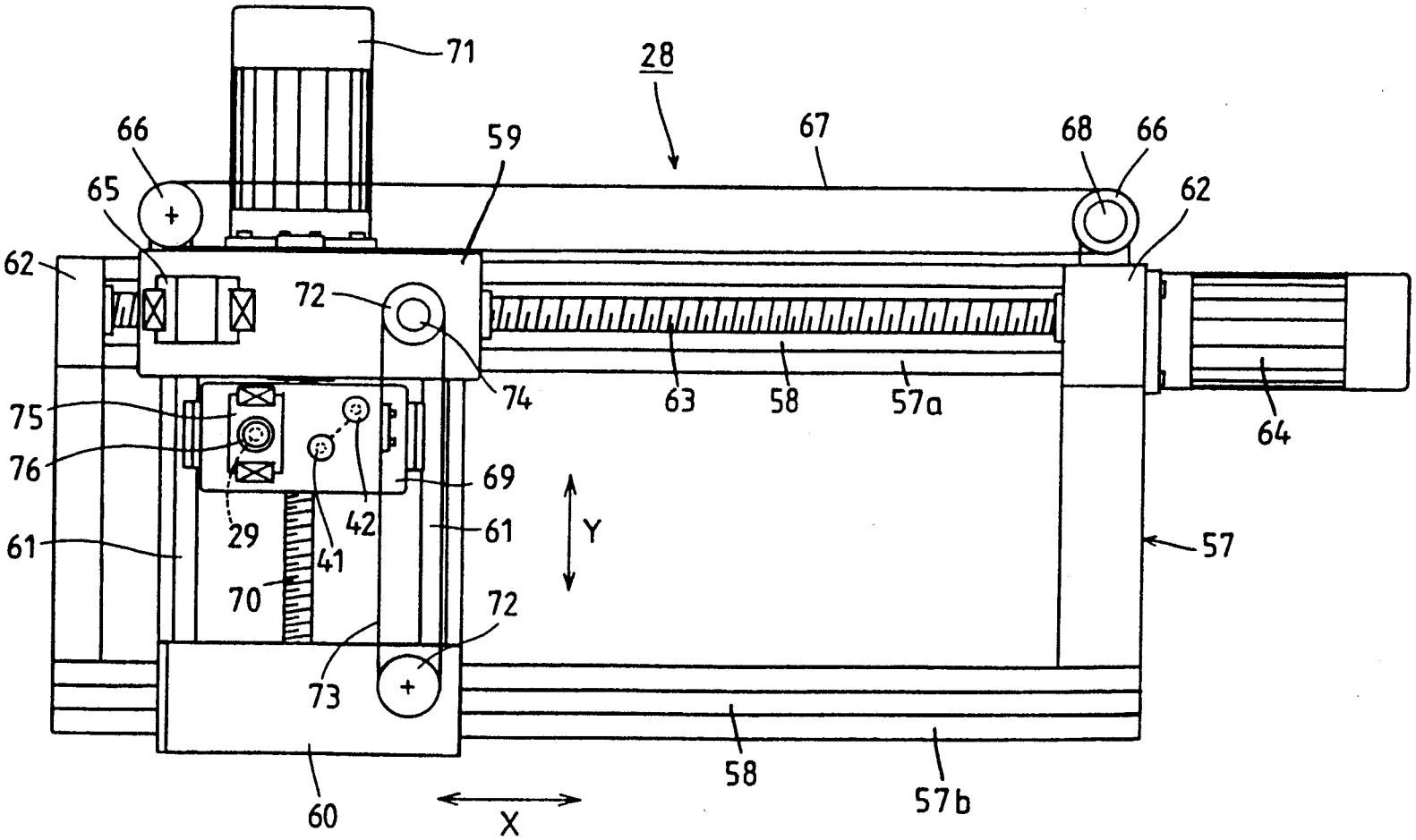
FIG. 6 is a plan view of a position adjuster.
Figure 9:
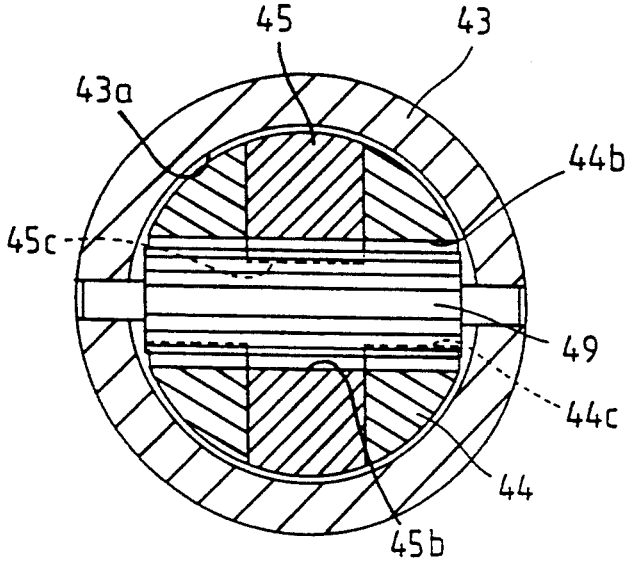
FIG. 9 shows in vertical cross section the major section of the constraining jig.

A rectangular frame 57 constituting the body of the position adjuster 28 is disposed horizontally at a predetermined position below which the constrainers 19 disposed to the endless chains 18 can successively be positioned horizontally by rotating the drive shaft 15 intermittently. As shown in FIG. 6, the frame 57 has a pair of frame members 57*a*,57*b* extending parallel with the slide shafts 22 of the constrainer 19, and a pair of guide rails 58 are disposed to these frame members 57*a*,57*b* respectively in the longitudinal directions thereof. A first carriage 59 and a guide piece 60 are slidably disposed respectively to these rails 58. The first carriage 59 and the guide piece 60 are linked by a pair of guide rails 61 extended to be parallel to the guide shafts 26, so that they can be moved integrally.

One frame member 57*a* has a first ball screw 63 supported rotatably between a pair of bearings 62 disposed to each end of the frame member 57*a*, and the first ball screw 63 is designed to be rotated positively or negatively by a first servo motor 64 disposed to one bearing 62. Namely, by driving the first servo motor 64 normally or reversely to rotate the first ball screw 63, the first carriage 59 and the guide piece 60 can be moved together along the guide rails 58 in the axial direction (X) of the slide shafts 22 under the cooperative actions of the ball screw 63 and a nut (not shown). Incidentally, the first carriage 59 and the guide 60 are designed to be shiftable slightly with the aid of a floater 65 in the direction (Y) orthogonal to the direction in which they are fed.

A pair of toothed pulleys 66 are rotatably disposed to the frame member 57*a* to be spaced from each other with a predetermined distance therebetween in the axial direction of the first ball screw 63, and a toothed belt 67 is extended across these pulleys 66. The toothed belt 67 is fixed at an appropriate portion to the first carriage 59, so that the toothed pulleys 66 can be rotated by the toothed belt 67 as the first carriage 59 is fed. Meanwhile, a first encoder 68 which detects revolution number of the pulleys 66 is disposed to one pulley 66. Detection signals from the encoder 68 are input to, for example, a control means (not shown) having a built-in microcomputer so as to monitor the present position of the first carriage 59 constantly.

A second carriage 69 is slidably disposed to the pair of guide rails 61 extended across the first carriage 59 and the guide piece 60. A second ball screw 70 is rotatably supported between the first carriage 59 and the guide piece 60 parallel to the guide rails 61 and screwed into a nut (not shown) disposed to the second carriage 69. A second servo motor 71 for rotating the second ball screw 70 positively or negatively is disposed to the first carriage 59, so that the second carriage 69 can be moved along the guide rails 61 in the direction (Y) parallel to the axis of the guide shaft 26 under the cooperative actions of the second ball screw 70 and the nut by driving the motor 71 normally or reversely to turn the second ball screw 70.

A pair of toothed pulleys 72 are rotatably disposed to the first carriage 59 and the guide piece 60 respectively, and a toothed belt 73 is extended across these pulleys 72. The toothed belt 73 is fixed at an appropriate portion to the second carriage 69, so that the toothed pulleys 72 can be rotated by the toothed belt 73 as the second carriage 69 is fed. A second encoder 74 which detects revolution number is disposed to one toothed pulley 72, and detection signals from the encoder 74 are input to the control means, so that the present position of the second carriage 69 can constantly be monitored.

As shown in FIG. 6, a positioning air cylinder 76 is disposed via a floater 75 to the second carriage 69 at an appropriate position in such a way that it can be shifted slightly in the direction (X) orthogonal to the direction in which the second carriage 69 is to be fed. A positioning pin 29 is disposed to the free end of the piston rod of the cylinder 76, which is designed to be inserted to the opening 27*a* defined in the base 27 and link the second carriage 69 with the base 27 so as to be able to be moved integrally. Incidentally, it is recommendable to form tapers at the tip of the positioning pin 29 and the edge of the opening 27*a* respectively so that the tip of the positioning pin 29 may smoothly be inserted to the opening 27*a*.

A releasing air cylinder 41 and a clamping air cylinder 42 are disposed to the second carriage 69 in such a positional relationship where they oppose respectively to the release lever 39 and clamp lever 40 of the cam 36 disposed to the base 27. The cam 36 is turned counterclockwise by the release lever 36, as shown in FIG. 7(*a*) by operating the releasing air cylinder 41 to extend its piston rod 41*a*, whereby to release locking of the base 27. Meanwhile, the cam 36 is turned clockwise by the clamp lever 40, as shown in FIG. 7(*b*), by operating the clamping air cylinder 42 to extend its piston rod 42*a*, whereby to lock the base 27 in position.

Namely, the air cylinder 76 is operated to insert the positioning pin 29 into the opening 27*a* of the base 27 when a constrainer 19 is fed to the position below the position adjuster 28, and thus the second carriage 69 can be linked with the base 27. Subsequently, by driving the first servo motor 64 normally or reversely to rotate the first ball screw 63, the first carriage 59 and the guide piece 60 are fed along the guide rails 58, as well as, the carriers 23 along the corresponding slide shafts 22. Meanwhile, by driving the second servo motor 71 normally or reversely to rotate the second ball screw 70, the second carriage 69 is moved along the guide rails 61, as well as, the base 27 along the guide shafts 26. Thus, the position of the constraining jig 24 disposed to the base can be adjusted in the direction of X as well as in the direction of Y.

By the way, if data on the length and camber profile of the leaf 10 to be quenched are preliminarily input to the control means, the servo motors 64,71 are driven under control based on these data when the position of each constraining jig 24 is adjusted to allow adjustment of four constraining jigs 24 in the constrainer 19 in position along the camber profile of the leaf 10 (see FIG. 1). Incidentally, as the mechanism for monitoring the present position of the carriages 59,69, encoders may be disposed to the respective servo motors 64,71, instead of the toothed pulley/toothed belt system, to input detection signals from the encoders to the control means.

Conveyor

As shown in FIG. 2, the conveyor 14 disposed downstream the constraining apparatus 13 has a plurality of attachments 77 arranged in the running direction at predetermined intervals and is designed to be able to circulate in the oil tank 12 to feed the leaves 10 retained on these attachments 77 in the oil.

Other Incidental Equipments

A transferring device (not shown) such as a manipulator is disposed at an upstream position in the oil tank 12 in the line of feeding leaves 10, so that the leaves 10 cambered in the previous step may be transferred one by one to the constrainers 19 of the constraining apparatus 13. Another transferring device (not shown) such as a manipulator for unloading the leaves 10 from the respective constrainers 19 and transferring them to the conveyor 14 is disposed at a position downstream the constraining apparatus 13. Incidentally, transference of the leaves 10 from the constraining apparatus 13 to the conveyor 14 is designed to be carried out as they are immersed in the oil. Thus, occurrence of any possible distortion of the leaves 10 or fuming, attributable to temperature change to be caused by taking out the leaves 10 once from the oil, can be prevented.

Now, function of the thus constituted constraining apparatus 13 will be described. It should be noted here that data on the length and camber profile of the leaves 10 to be quenched are input to the control means before operating the constraining apparatus 13. Meanwhile, it should be appreciated that the relative positions of the constraining jigs 24 disposed to the bases 27 in each constrainer 19 are adjusted based on the data and that the pair of jaws 46 in each constraining jig 24 are assuming an open state (a state where the jaws 46 are spaced from each other) to allow insertion of a leaf 10 therebetween.

In this state, a leaf 10 is supplied to the constrainer 19 locating at the leaf supply position above the oil surface in the oil tank 12, as shown in FIG. 2. Since the jaws 46 in each constraining jig 24 in the constrainer 19 are open, the leaf 10 can be placed on the arm 44*a* of the holder 44 in such a state that one side face orthogonal to the thickness of the leaf 10 is in contact with the upper surface of the arm 44*a* (see FIG. 8). In this process, the leaf 10 is abutted against the auxiliary levers 48 disposed to the holder 44 to turn the constraining jig 24 relative to the base 27, as shown in FIG. 8, to allow the leaf 10 to be in contact with the arm 44*a* substantially parallel.

The holders 44,45 respectively move in the directions to bring their jaws 46 closer to each other under the engagement of the racks 44*c*,45*c* of the holders 44,45 with the pinion 49 by advancing the thrust shaft 50 by the drive means disposed at the leaf supply position with the timing the leaf 10 is placed between the jaws 46. At the position where the constraining surfaces 46*a* of the jaws 46 are abutted against the longitudinal side edges of the leaf 10, the urging of the thrust shaft 50 is released, and the thrust shaft 50 is prevented from retracting by the latches 52 engaging with the corresponding toothed portions 50*a* thereof. Since the thrust shaft 50 and the holder 45 are urged to be spaced from each other in this state by the resilience of the compression spring 51, the leaf 10 can securely be held between the jaws 46. Meanwhile, since the constraining surfaces 46*a* of the jaws 46 are slanted in such a way that they are spaced farther from each other toward the upper surface of the arm 44*a*, as shown in FIG. 8(*a*), the leaf 10 held therebetween can be constrained in the directions of the thickness and width thereof. The leaf 10 can thus be constrained in said directions at ten positions by ten constraining jigs 24 disposed to the constrainer 19. Incidentally, the advancing stroke of the thrust shaft 50 is set based on the input data of the leaf spring 10.

Figure 3:
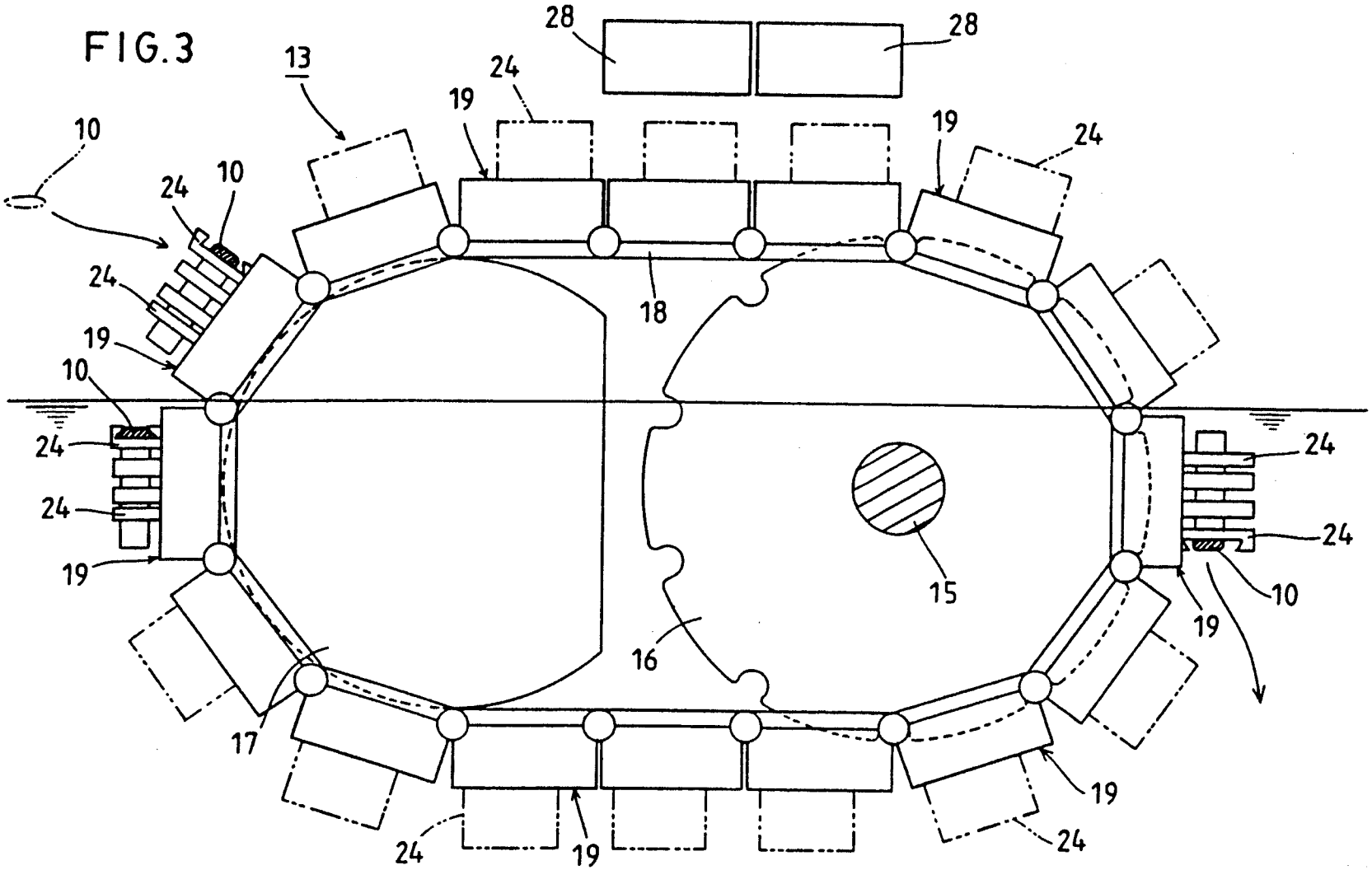
FIG. 3 is a schematic side view of the constraining apparatus.

Subsequently, the drive shaft 15 is intermittently driven counterclockwise to allow the sprockets 16 to turn by 36°, and thus the constrainer 19 locating at the leaf supply position is fed and immersed in the oil as the endless chains 18 run, as shown in FIG. 3, to effect quenching of the leaf 10 constrained thereby. Namely, since the leaf 10 is immersed in the oil while it is constrained at ten positions in the directions of the thickness and width thereof, any possible distortion in said directions concomitantly occurring with quenching can effectively be prevented, making it possible to carry out quenching with high accuracy. Besides, since the thus quenched leaf 10 has no distortion, correcting operations after quenching can be obviated to improve productivity. It should be noted here that the leaf 10 is desirably immersed in the oil in such a way that its side faces parallel to the width thereof may be orthogonal to the oil surface. In the present embodiment, the leaves 10 constrained respectively by the constrainers 19 can be immersed in the oil in such a way that its side faces parallel to the width thereof may be orthogonal to the oil surface by using long endless chains 18 and a fixed disc 17 having a great diameter.

The next constrainer 19 is brought to the leaf supply position by turning the sprockets 16 counterclockwise by 36°, and the constraining jigs 24 in this constrainer 19 assume a stand-by posture with their jaws 46 being open for receiving a leaf 10. Upon supply of a leaf 10 to the group of constraining jigs 24 by the transferring device, the thrust shaft 50 is advanced, in the same manner as described above, to allow the jaws 46 of each constraining jig 24 to hold the leaf 10 therebetween. Subsequently, by turning the sprockets 16 by 36°, the leaf 10 is immersed in the oil while it is constrained by the jaws 46. A plural number of leaves 10 can thus be quenched by turning the sprockets 16 by 36° each time a leaf 10 is transferred from the previous step.

Upon arrival of the constrainer 19 having a leaf 10 constrained therein to the leaf unloading position after rotation of the sprockets 16, the drive means of the mechanism for operating each pair of jaws 46 is actuated to allow the jaws 46 to release the leaf 10. Namely, the thrust shaft 50 is first advanced slightly by the drive means to loosen the engagement between the toothed portions 50*a* and the latches 52. The releasing member 55 is then advanced by the drive means to allow the rollers 52*b* of the latches 52 to roll along the tapered portion 55*b*, as shown in FIG. 10, whereby to release the engagement of the claws 52*a* of the latches 52 with the toothed portions 52*a* of the thrust shaft 50. By retracting the thrust shaft 50 in this state, the holder 45 connected to the thrust shaft 50 via the compression spring 51 is retracted to allow the other holder 44 to advance and bring the jaws 46 farther from each other, whereby to release the leaf 10. The thus released leaf 10 is unloaded by the transferring device and transferred to the downstream conveyor 14. The quenching of the leaf 10 is fully completed to have a stabilized camber profile up to this moment, so that it undergoes substantially no distortion during transportation on the conveyor 14 under no constraint in the oil. Besides, since the leaf 10 is not taken out of the oil to be exposed to air when the leaf 10 is transferred from the constraining apparatus 13 to the conveyor 14, occurrence of any distortion of the leaf 10 or fuming to be caused by temperature change can be prevented. Incidentally, the release member 55 retracts by the resilience of the compression spring 56 by releasing the urging of the release member 55 when the jaws 46 are spaced from each other to the positions where the leaf 10 can be removed. The latches 52 engage with the toothed portions 50*a* of the thrust shaft 50 to allow the jaws 46 to maintain an open posture.

Operations of Adjusting Position of Constraining Jig

Next, when leaves 10 of a type having a different length and a different camber profile are to be quenched depending on the order change, new data on these leaves 10 are input to the control means (not shown), and the position adjusters 28 are operated based on these data to effect adjustment of the relative positions of the respective constraining jigs 24.

Upon arrival of a constrainer 19 at the position below the upstream side position adjuster 28 locating above the oil tank 12, the first servo motor 64 and the second servo motor 71 are driven under control to move the first carriage 59 in the direction X and the second carriage 69 in the direction Y. The positioning pin 29 disposed to the second carriage 69 is aligned with the opening 27*a* of the base 27, which has been locked in position based on the data of the previous order. Subsequently, the air cylinder 76 is operated to insert the positioning pin 29 into the opening 27*a* and link the second carriage 69 with the base 27 so as to be able to move integrally. Since the air cylinder 76 is designed to be shiftable slightly in the direction X with the air of the floater 75 relative to the second carriage 69, whereas the first carriage 59 and the guide piece 60 are designed to be shiftable slightly in the direction Y by the floater 65, the positioning pin 29 can smoothly be inserted to the opening 27a by floating the first carriage 59 and guide piece 60 as well as the second carriage 69 even when the axis of the positioning pin 29 is slightly deviated from that of the opening 27a. Incidentally, the correct position of the positioning pin 29 can be monitored by allowing the first encoder 68 and the second encoder 74 to read the movement of the positioning pin 29 by the floaters 65,75.

Figure 7A:
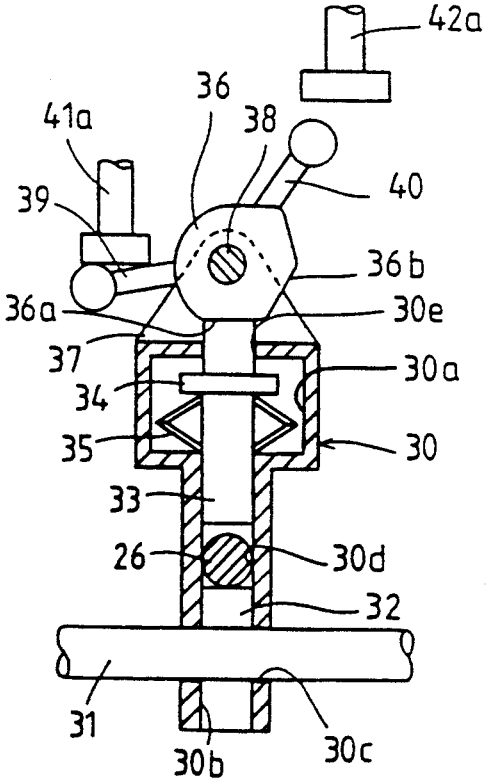
FIGS. 7(*a*) and 7(*b*) illustrate how a position locking mechanism is operated.

After the second carriage 69 is linked with the base 27, the releasing air cylinder 41 is operated to allow its piston rod 41a to push down the release lever 39 and turn the cam 36 counterclockwise, as shown in FIG. 7(a). Thus, the first cam surface 36a of the cam 36 is abutted against the locking member 33 to allow the lower end thereof to be spaced from the guide shaft 26, and thus locking of the base 27 can be released. Subsequently, the first servo motor 64 and the second servo motor 71 are driven under control to move the base 27 in the direction X as well as in the direction Y based on the new data to carry out adjustment of the constraining jig 24.

Figure 7B:
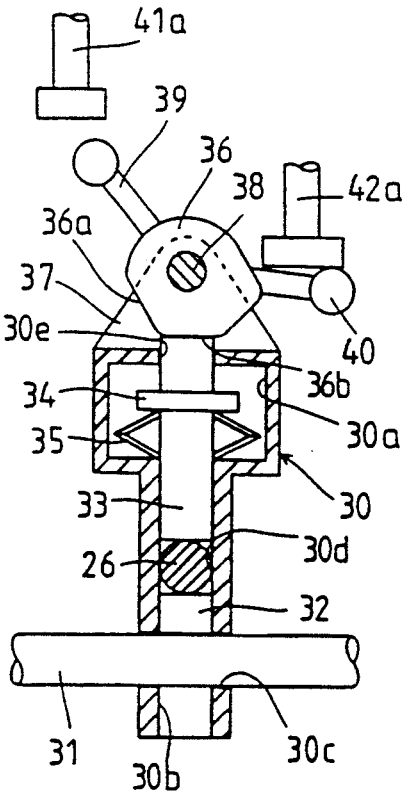

After the position of the jig 24 is properly adjusted, the clamping air cylinder 42 is operated to allow its piston rod 42a to push down the clamp lever 40, as shown in FIG. 7(b), whereby to turn the cam 36 clockwise. Thus, the second cam surface 36b of the cam 36 is abutted against the locking member 33 to allow the lower end thereof to be abutted against the guide shaft 26 and the pusher 32 against the corresponding positioning bar 31. Accordingly, the position of the base 27 is adjusted in the direction X as well as in the direction Y and locked. The air cylinder 76 is then operated reversely to draw out the positioning pin 29 from the opening 27a of the base 27 and release linkage between the second carriage 69 and the base 27. Thus, positioning of one constraining jig 24 is completed.

After the positions of four constraining jigs 24 locating on the right side of the center frame 20 in the constrainer 19 are adjusted as described above, the sprockets 16 are rotated intermittently to bring the constrainer 19 below the downstream side position adjuster 28, where the positions of four constrainers 19 locating on the left side of the center frame 20 in the constrainer 19 are adjusted by the position adjuster 28 to complete positioning of all the constraining jigs 24 in the constrainer 19.

As described above, positioning of the constraining jigs 24 can automatically be carried out by the position adjusters 28 in accordance with the order changes by preliminarily inputting the data on the lengths and camber profiles of various types of leaves 10 to the control means. Accordingly, the change-over time required for each order change can be reduced to improve productivity. Incidentally, the time required for the position adjustment can further be reduced if the desired pattern of position adjustment is designed to be selected from the data on the specifications of various types of leaves 10 (e.g. lengths and camber profiles) only by pressing a predetermined set button. In addition, since the constrainers 19 are designed to be disposed onto a pair of endless chains 18, the number of constrainers 19 can readily be changed by changing the length of the endless chains 18 or the positions of the sprockets 16.

It should be understood that while two separate position adjusters are used so as to carry out positioning of the constraining jigs locating on the left side of the center frame and those locating on the right side of the center frame of the constrainer, respectively, it is also possible to adjust the positions of all the constraining jigs in one constrainer by using one position adjuster. All of the eight constraining jigs disposed on each side of the center frame of the constrainer may not always be used, and for example only six of them may be used depending on the length of the leaf.

Further, while the positions of the constraining jigs are adjusted automatically by the position adjusters in the above embodiment, the position of each constraining jig can also be adjusted manually by an operator using a model leaf. In this case, the position adjusters can be omitted, leading to cost reduction.

What is claimed is:

1. An apparatus for quenching leaf springs comprising:

a tank with a quenching liquid therein;

a constraining apparatus for constraining leaf springs to which a camber has been imparted; and drive means provided in said tank for driving said constraining apparatus into and out of said quenching liquid in said tank;

wherein said constraining apparatus comprising:

a pair of endless chains installed with a space in between, under halves of said endless chains being in said quenching liquid and upper halves of said endless chains being above a surface of said quenching liquid; and a plurality of constrainers provided on said pair of endless chains for constraining leaf springs thereon, said constrainers being spaced with predetermined intervals in a direction in which said endless chains are rotated, and each one of said constrainers comprising:

a pair of support frames installed with a space in between and facing each other;

a pair of slide shafts provided parallel to each other and between said pair of support frames;

a plurality of pairs of carriers provided on said pair of slide shafts so as to be slidable on said slide shafts;

a pair of parallel guide shafts provided in each one of said pair of carriers;

a base provided on said parallel guide shafts so as to be slidable on said pair of guide shafts in a direction perpendicular to a sliding direction of said carriers;

a constraining jig provided on said base for constraining a leaf spring blank in directions of thickness and width of said leaf spring;

a positioning bar inserted in a slidable fashion into a through hole opened on one surface of said base, one end of said positioning bar being coupled to a center frame which is fixedly provided between said pair of support frames; and a locking member provided on said base, said locking member pressing said positioning bar such that said carriers and said base are immovable to accomplish a positioning of said constraining jig.

2. An apparatus for quenching leaf springs according to claim 1, further comprising a position adjuster provided above a surface of said quenching liquid and near a moving path of said constraining apparatus, said position adjuster moving and adjusting said constraining jig in a direction of length of said leaf spring and in a direction of camper of said leaf spring.

3. An apparatus for quenching leaf springs according to claim 2, said position adjuster comprising a first carriage provided movably in a direction of movement of said carriage, a second carriage provided on said first carriage so as to be movable in a direction of movement of said base, and a connecting pin for connecting and releasing said second carriage to and from said base.

* * * * *